United States Patent [19]

Koyama et al.

[11] Patent Number: 4,895,782

[45] Date of Patent: Jan. 23, 1990

[54] PROCESS FOR PREPARING DISPERSION LIQUID CONTAINING ORGANIC, PHOTOCONDUCTIVE AZO PIGMENT AND PROCESS FOR PREPARING ELECTROPHOTOGRAPHIC, PHOTOSENSITIVE MEMBER

[75] Inventors: Takashi Koyama; Hajime Miyazaki; Hideki Anayama, all of Yokohama, Japan

[73] Assignee: Canon Kabushiki Kaisha, Tokyo, Japan

[21] Appl. No.: 200,851

[22] Filed: Jun. 1, 1988

[30] Foreign Application Priority Data

Jun. 2, 1987 [JP] Japan ..... 62-139308

[51] Int. Cl.[4] ..... G03G 5/10

[52] U.S. Cl. ..... 430/58; 430/76; 430/135

[58] Field of Search ..... 430/59, 58, 70, 71, 430/72, 73, 74, 75, 76, 77, 78, 135

[56] References Cited

U.S. PATENT DOCUMENTS 4,743,523 5/1988 Yamashita et al. ..... 430/73

4,760,003 7/1988 Matsumoto et al. ..... 430/73

*Primary Examiner*—John L. Goodrow

*Attorney, Agent, or Firm*—Fitzpatrick, Cella, Harper & Scinto

[57] ABSTRACT

A process for preparing a dispersion liquid containing an organic photoconductive azo pigment by use of a solvent is provided which comprises subjecting the azo pigment to a heating treatment in a ketone type solvent as a dispersion pretreatment. The azo pigment is characterized by the general formula (1) wherein $R_1$ represents a hydrogen atom or a substituted or unsubstituted alkyl group and A represents a coupler residue having a phenolic hydroxyl group.

12 Claims, 1 Drawing Sheet

PROCESS FOR PREPARING DISPERSION LIQUID CONTAINING ORGANIC, PHOTOCONDUCTIVE AZO PIGMENT AND PROCESS FOR PREPARING ELECTROPHOTOGRAPHIC, PHOTOSENSITIVE MEMBER

BACKGROUND OF THE INVENTION

1. Field of the Invention

This invention relates to a process for preparing a dispersion liquid containing an organic, photoconductive azo pigment showing stable electrophotographic characteristics and a process for preparing in electrophotographic, photosensitive member.

2. Background of the Invention

Heretofore, electrophotographic, photosensitive members comprising an inorganic photoconductive substance, such as selenium, cadmium sulfide zinc oxide, etc. have been widely used.

On the other hand, electrophotographic, photosensitive members comprising an organic, photoconductive substance such as a photoconductive polymer represented, for example, by poly-N-vinylcarbazole, or a lower molecular weight, organic photoconductive substance represented, for example, by 2,5-bis(p-diethylaminophenyl)-1,3,4-oxadiazole, or combinations of these organic photoconductive substances with various dyes or pigments have been known.

Electrophotographic, photosensitive members comprising an organic, photoconductive substance have such advantages as a good film formability, a capability to form a film by coating, a high productivity, a low cost, etc. and further have such an advantage that the color sensitivity can be controlled as desired by selecting a photosensitizer such as a dye, a pigment, etc. to be used. Thus, they have been extensively investigated. Particularly owing to the recent development of a photosensitive member of the functionally separated type comprising a layer containing an organic photoconductive pigment as a charge-generation layer and a layer containing the aforementioned photoconductive polymer, low molecular weight organic photoconductive substance, etc. as a charge-transport layer, laminated to each other, remarkable improvements have been made to the sensitivity and the durability which have heretofore been regarded as the disadvantages of the conventional organic electrophotographic, photosensitive members, which improvements have promoted their practical applications.

Furthermore, various pigments applicable to the photosensitive member of functionally separated type, such as azo pigments, etc. have been also already found. It is also known that the sensitivity and spectroscopic characteristics of such an electrophotographic, photosensitive member depend upon the particle size and crystal form of the pigments as charge-generating substances.

According to a conventional process, a pigment prepared through a synthetic reaction is dispersed into solvent together with a binder by means of a Lall mill, sand mill or attriter over several hours to several ten hours to obtain a photoconductive composition (dispersion liquid). The process for directly dispersing the pigment into a solvent has a problem in obtaining a dispersion liquid containing uniform particles. This problem occurs owing to coarse particles being liable to precipitate in the dispersion liquid when wettability of the pigment is poor upon dispersing.

An electrophotographic, photosensitive member prepared from such an electroconductive composition containing coarse particles has not only reduced the number of carrier generations owing to a decrease in the trapping power, but also reduced carrier mobility owing to the increased void due to coarse particles, and furthermore has a deteriorated sensitivity such as reduced efficiency of carrier injections into the charge-transport layer owing to high roughness on the surface of the charge generation layer, etc.

The number of coarse particles can be indeed reduced by prolonging the dispersion treatment time of particles, but the already finely dispersed particles are excessively dispersed thereby and thus the coagulation state is liable to change and the particle side is also liable to change during or after the dispersing step, considerably deteriorating the stability of the dispersion.

In case of pigments whose crystal form transition proceeds in a dispersing solvent, the transition state of crystal form changes with a slight deviation in the dispersing conditions. Sometimes the stabilities of dispersion liquids with respect to time are diversified in not only sensitivity but also in the spectroscopic characteristics of the thus prepared electrophotographic, photosensitive members in each dispersion batch.

SUMMARY OF THE INVENTION

An object of the present invention is to provide a process for preparing a dispersion liquid containing fine particles of an organic photoconductive material in a stable crystal state, wherein the coagulation state of the dispersion liquid is barely changed with the lapse of time after being dispersed.

Another object of the present invention is to provide a process for preparing an electrophotographic, photosensitive member with a high sensitivity and stable characteristics of spectrometric sensitivity.

As a result of extensive studies, the present inventors have found that these objects can be attained by carrying out a specific treatment as a dispersion pretreatment in the preparing of a dispersion liquid containing an organic photoconductive azo pigment with a specific structural formula, and have established the present invention on the basis of this finding.

That is, the present invention provides a process for preparing a dispersion liquid containing an organic photoconductive azo pigment represented by the following general formula [1] by use of a solvent, which comprises subjecting the azo pigment to a heating treatment in a ketone type solvent as a dispersion pretreatment:

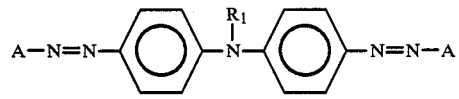

[1]

wherein $R_1$ represents a hydrogen atom, or a substituted or unsubstituted alkyl group and A represents a coupler residue having a phenolic hydroxyl group.

Furthermore, the present invention provides a process of preparing an electrophotographic, photosensitive member, which comprises (a) a step of forming a charge generation layer by applying and drying a dispersion liquid containing an organic photoconductive azo pigment represented by the following general formula [1]:

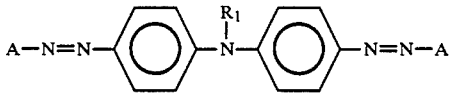

wherein $R_1$ represents a hydrogen atom or a substituted or unsubstituted alkyl group and A represents a coupler residue having a phenolic hydroxyl group, said azo pigment being subjected to a heating treatment in a ketone type solvent as a dispersion pretreatment, and (b) a step of forming a charge transport layer by applying and drying a solution of a charge-transporting substance, said charge transport layer being formed on an electroconductive support either before or after formation of said charge generation layer.

DETAILED DESCRIPTION OF THE INVENTION

Figure 1:
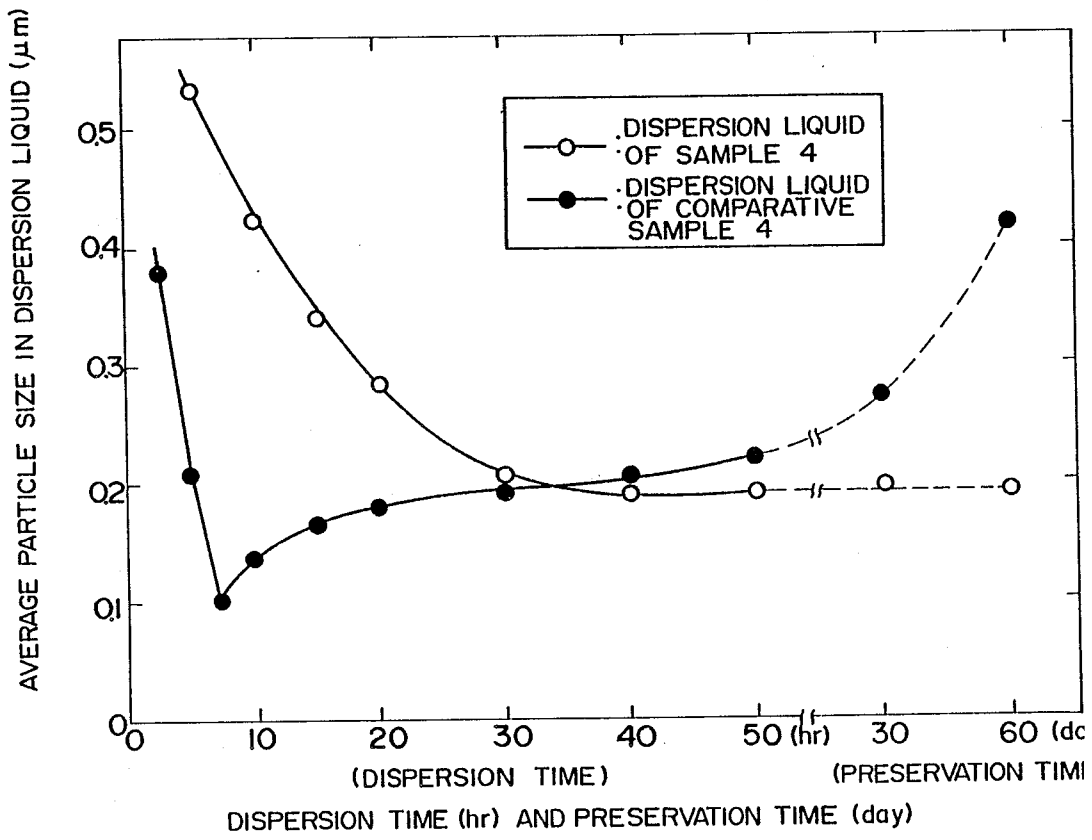
FIG. 1 is a diagram showing changes in the particle sizes of pigment particles with a dispersion time.

In the general formula [1], $R_1$ represents a hydrogen atom, or an alkyl group such as methyl, ethyl, propyl, butyl, etc., and the alkyl group may have a substituent such as hydroxyl, a halogen atom, etc.

In the general formula [1], the coupler residue represents an aromatic hydrocarbon compound having a hydroxyl group such as phenols, naphthols, etc. and a heterocyclic compound having a hydroxyl group. Particularly, the heating treatment in a ketone solvent is an effective dispersion pretreatment in the process for preparing a dispersion liquid containing a photoconductive azo pigment, where A of the general formula [1] is given by the following general formula [2]:

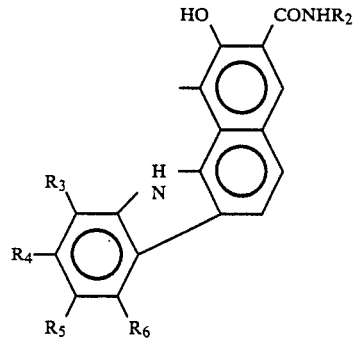

[2]

wherein $R_2$ represents a substituted or unsubstituted alkyl group, aryl group, aralkyl group or heterocyclic group; $R_3$, $R_4$, $R_5$ and $R_6$ represent a hydrogen atom, a halogen atom such as fluorine, chlorine, bromine, iodine, etc., hydroxyl, nitro, trifluoromethyl, cyano alkyl, alkoxy or a substituted or unsubstituted aryl, aralkyl or amino group.

Specific structures of the general formula [2] include, for example,

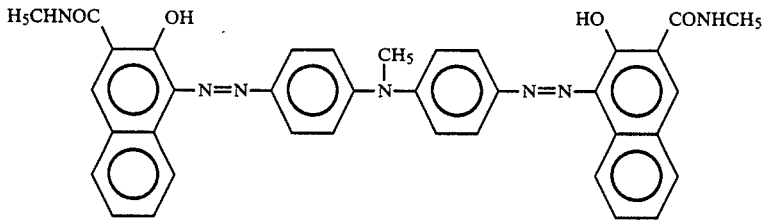

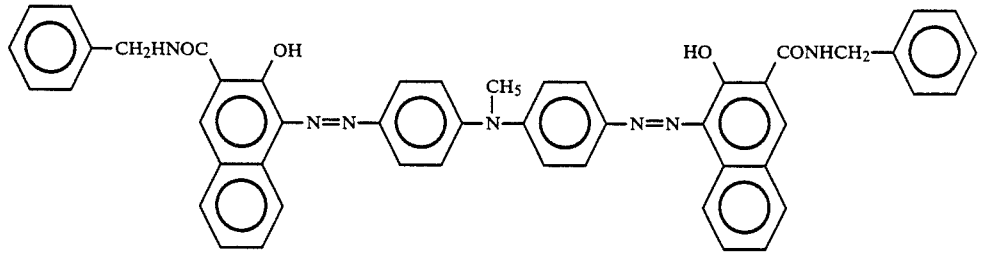

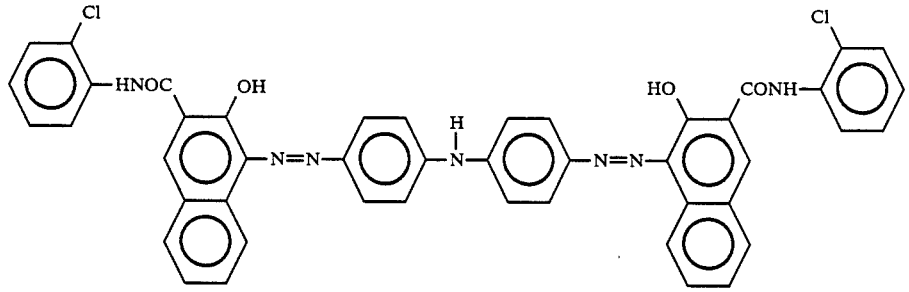

-continued
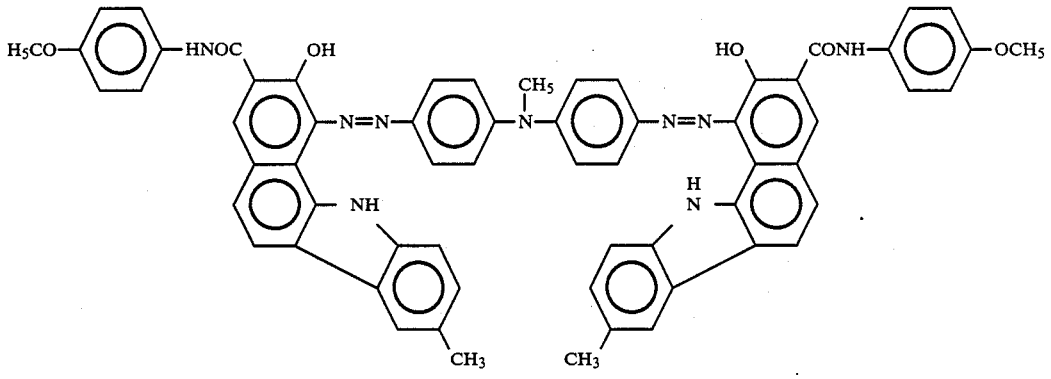
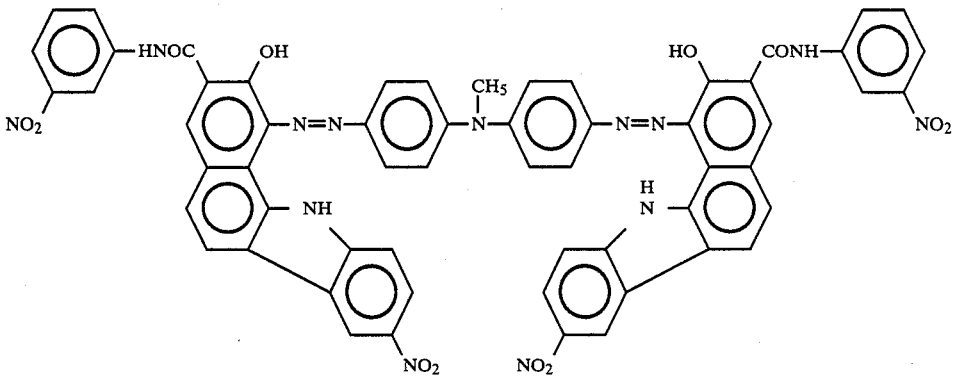
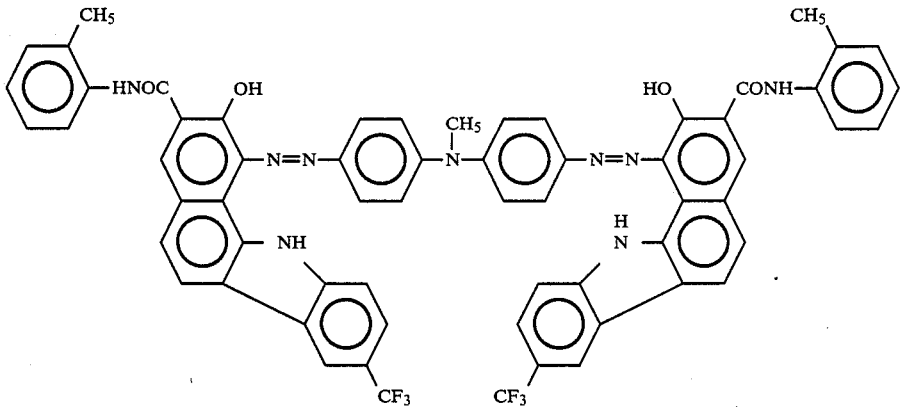
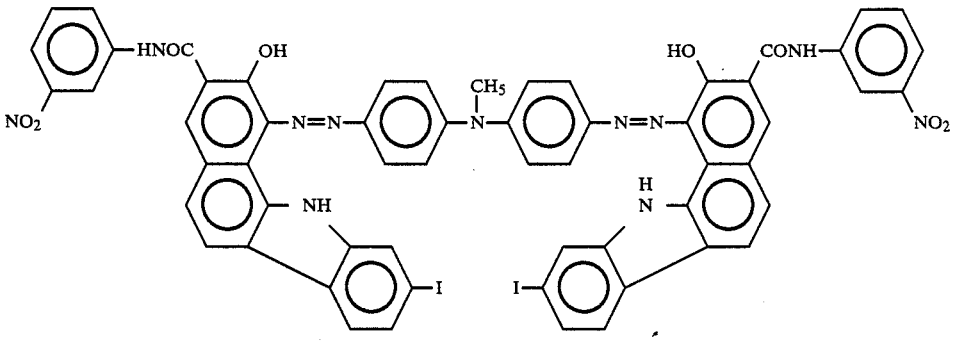

-continued

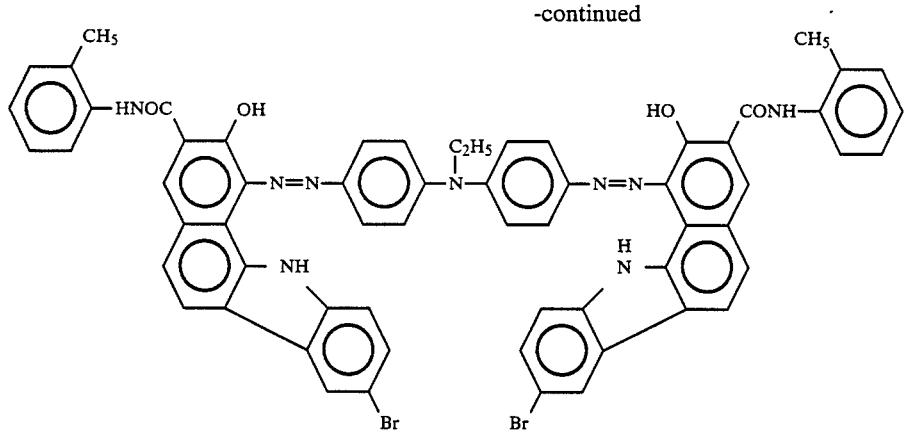

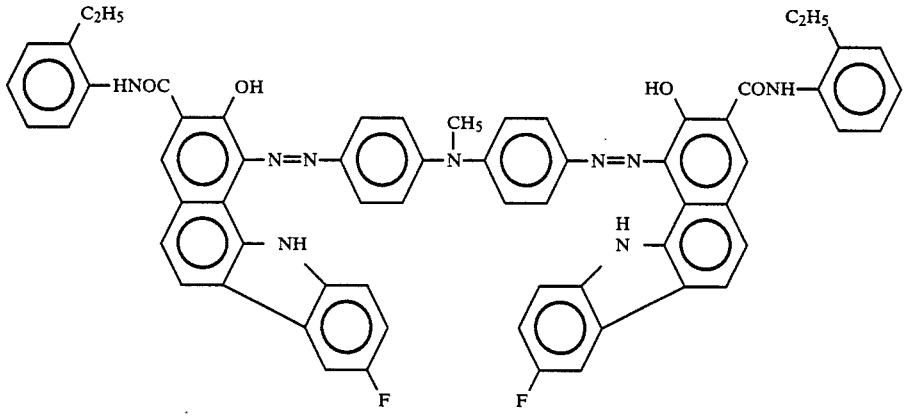

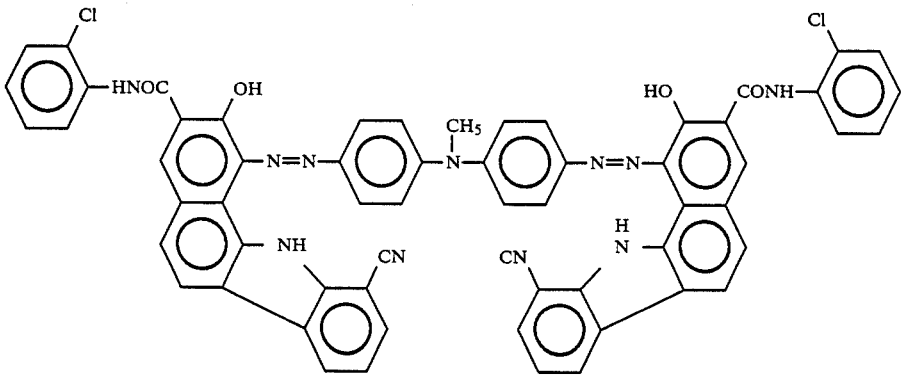

The present invention using the above-mentioned azo pigment will be described in detail below:

The ketone type solvent for use in the present heating treatment includes, for example, acetone, methylethylketone, methylisobutylketone, diethylketone, ethyl-n-butylketone, di-n-propylketone, acetonylacetone, diacetone alcohol, mesityl oxide, cyclopentanone, cyclohexanone, methylcyclohexanone, isophorone, acetophenone, etc. They can be used alone or in a mixture of at least two thereof. From the viewpoint of the liquid stability, methylisobutylketone, di-n-propylketone, cyclopentanone and cyclohexanone are preferable among them.

The heating treatment in a solvent in the present invention is carried out preferably with stirring in order to attain better contact of pigment particles with the solvent and uniform temperature distribution throughout the solvent.

The heating treatment conditions, such as temperature, time, etc. are decided in view of the liquid stability after dispersion, characteristics, etc. of an electrophotographic, photosensitive member to be prepared are considered. The treatment temperature is preferably 50° C. or higher.

The pigment after the heating treatment may be in a wet state containing the solvent or a dry state free from the solvent.

The solvent after the heating treatment contains impurities from the pigment and thus in order to obtain a high purity pigment it is preferable to remove the solvent and the impurities by filtration, etc.

The azo pigment heat-treated in the ketone type solvent as the dispersion pretreatment according to the present invention has an improved wettability upon dispersion, and can be uniformly dispersed without forming coarser particles by coagulation, and thus can form a dispersion liquid with a distinguished stability. Furthermore, the dispersion liquid can be formed within a shorter dispersion time and the finely dispersed particles are not excessively dispersed, resulting in the improvement of liquid stability of the resulting composition.

Pigments that undergo crystal form transition in the solvent can complete the crystal form transition by the heating treatment, and thus the most stable crystal form can be obtained at the end of the heating treatment. In other words, pigments whose crystal form contributes to the spectroscopic sensitivity of the thus prepared electrophotographic photosensitive member can stably give a photosensitive member with a specified spectroscopic sensitivity through the heating treatment. From the viewpoint of the sensitivity and spectroscopic characteristics, the heating treatment in the solvent is a particularly effective means for treating the pigments to be applied to an electrophotographic photosensitive member for the semi-conductor laser printer because the spectroscopic characteristics can be shifted to a longer wavelength region by the crystal transition in the solvent.

The pigment subjected to the heating treatment as the dispersion pretreatment is then transferred to the dispersion step.

Solvents for use in dispersion of the pigment are preferably solvents soluble in the ketone type solvent used in the heating treatment from the viewpoint of the wettability of the pigment, and include the same ketone type solvents as used in the heating treatment and solvent mixtures comprising a ketone type solvent and at least one of alcoholic solvents such as methanol, ethanol, isopropyl alcohol (IPA), etc., aromatic solvents such as benzene, toluene, xylene, chlorobenzene, etc., ester type solvents such as ethyl acetate, n-butyl acetate, etc., ether type solvents such as tetrahydrofuran (THF), dioxane, methyl cellosolve, etc., dimethyl formamide (DMF), dimethyl acetamide (DMA), etc.

The binder resin to be added to the solvents includes polyvinylbutyral, formal resin, polyamide, polyurethane, cellulose-based resin, polyester, polysulfone, styrene-based resin, polycarbonate, acrylic resin, etc.

Specific dispersing means applicable according to the present invention includes a sand mill, a colloid mill, an attriter, a ball mill, etc.

In the eletrophotographic, photosensitive member of the functionally separated type, the charge generation layer can be formed by applying the dispersion liquid directly to an electroconductive support or to an underlayer, or to the charge transport layer which will be described later. The charge generation layer is desirably a thin film layer having a film thickness of not more than 5 μm, preferably 0.01 to 1 μm. This is because it is necessary that most of the incident beam is absorbed in the charge generation layer to generate many charge carriers and that the generated charge carriers are injected into the charge transport layer without any deactivation of charge carriers by recombinations or trapping.

The coating can be carried out by dip coating, spray coating, spiner coating, bead coating, Meyer bar coating, blade coating, roller coating, curtain coating, etc. The drying is carried out preferably under heating after a coating film becomes dry to the touch at room temperature. The heat drying can be carried out at a temperature of 30° to 200° C. for 5 minutes to 2 hours in a stationary state or under air blowing.

The charge transport layer is electrically connected to the charge generation layer and has functions to receive the charge carriers injected from the charge generation layer in the presence of an electric field and to transport the charge carriers to the surface. The charge transport layer may be laminated on the top surface of the charge generation layer or on the bottom surface of the charge generation layer. It is desirable that the charge transport layer is laminated on the top surface of the charge generation layer.

A substance that transports the charge carriers through the charge transport layer, which will be hereinafter referred to merely as "charge-transporting substance", is preferably substantially non-responsive to the wavelength region of electromagnetic waves which the charge generation layer is responsive to. The term "electromagnetic waves" herein used includes a definition of "light rays" in a broad sense, which includes γ-rays, X-rays, ultraviolet rays, visible light, near infrared rays, infrared rays, far infrared rays, etc. When the photo-responsive wavelength region of the charge transport layer is identical or overlaps with that of the charge generation layer, the charge carriers generated in both layers are trapped with each other, resulting in lowering of the sensitivity.

The charge-transporting substance can be classified into an electron transportable material and a positive hole transportable substance. The electron transportable substance includes electron-attractive substances such as chloranil, bromanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, 2,4,8-trinitrothioxanthone, etc., and polymerized products of these electron-attractive materials.

The positive hole transportable substance includes pyrene; N-ethylcarbazole, N-isopropylcarbazole; hydrazone type compounds such as N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, p-diethylaminobenzaldehyde-N,N-diphenylhydrazone, p-pyrrolidinobenzaldehyde-N,N-diphenylhydrazone, p-diethylbenzaldehyde-3-methylbenzthiazolinone-2-hydrazone, etc.; styryl-based compounds such as α-phenyl-4-N,N-diphenylaminostilbene, N-ethyl-3-(α-phenylstyryl) carbazole, 5-p-ditolylaminobenzylidene-5H-dibenzo-[a,d]cycloheptene, etc.; pyrazoline compounds such as 1-phenyl-3-(p-diethylaminostyryl)-5-(p-diethylaminophenyl)pyrazoline, 1-[pyridyl (2)]-3-(p-diethylaminostyryl)-5-(p-diethylaminoiphenyl)pyrazoline, 1-[lepidyl (2)]-3-(p-diethylaminostyryl)-5-(p-diethylaminophenyl)pyrazoline, 1-[pyridyl (2)]-3-(α-methyl-p-diethylaminostyryl)-5-(p-diethylaminophenyl)pyrazoline, 1-phenyl-3-(α-benzyl-p-diethylaminostyryl)-5-(p-diethylaminophenyl) pyrazoline, spiropyrazoline, etc.; oxazole compounds such as 2-(p-diethylaminostyryl)-6-diethylaminobenzoxazole, 2-(p-diethylaminophenyl)-4-(p-dimethylaminophenyl)-5-(2-chlorophenyl) oxazole, etc.; thiazole compounds such as 2-(p-diethylaminostyryl)-6-diethylaminobenzothiazole, etc.; triarylmethane compounds such as bis(4-diethylamino-2-methylphenyl)-phenylmethane, etc.; polyaryl alkanes such as 1,1-bis(4-N,N-diethylamino-2-methylphenyl) heptane, 1,1,2,2-tetrakis(4-N,N-dimethylamino-2-methylphenyl) ethane, etc.; triphenylamino; poly-N-vinylcarbazole; polyvinylpyrene; polyvinylanthracene; polyvinylacridine; poly-9-vinylphenylanthracene; pyrene-formaldehyde resin; ethylcarbazole-formaldehyde resin, etc.

Besides these organic charge-transporting materials, inorganic materials such as selenium, selenium-tellurium, amorphous silicon, cadmium sulfide, etc. can be used.

The charge-transporting substances can be used alone or in a mixture of at least two thereof.

When the charge-transporting substance has no film formability, a film can be formed together with an appropriately selected binder. The resin for use as the binder includes, for example, insulating resins such as acrylic resin, polyarylate, polyester, polycarbonate, polystyrene, acrylonitrile-styrene copolymer, acrylonitrile-butadiene copolymer, polyvinylbutyral, polyvinylformal, polysulfone, polyacrylamide, polyamide, chlorinated rubber, etc., and organic photoconductive polymers such as poly-N-vinylcarbazole, polyvinylanthracene, polyvinylpyrene, etc.

The charge transport layer has a limit to the transportation of charge carriers, and its film thickness cannot be made larger than the required thickness and is generally 5 μm to 30 μm, preferably 8 μm to 20 μm. The aforementioned, appropriate coating procedure can be used in the formation of the charge transport layer by coating.

A photosensitive layer comprising a charge generation layer and a charge transport layer in a laminated structure of this order is provided on an electroconductive support. The electroconductive support for use in the present invention includes those which have an electroconductivity by themselves, such as aluminum, aluminum alloy, copper, zinc, stainless steel, vanadium, molybdenum, chromium, titanium, nickel, indium, gold, platinum, etc.; plastics with a film layer of aluminum, aluminum alloy, indium oxide, tin oxide, indium oxide-tin oxide alloy or the like, formed by vacuum vapor deposition; the aforementioned metals or plastics coated with electroconductive particles such as carbon black particles, tin particles, etc. together with an appropriate binder; plastics or paper impregnated with the electroconductive particles; and plastics containing electroconductive polymers, etc.

An underlayer having a barrier function and an adhesive function can be provided between the electroconductive support and the photosensitive layer. The underlayer can be made from casein, polyvinyl alcohol, nitrocellulose, ethylene-acrylic acid copolymer, polyamides (Nylon 6, Nylon 66, Nylon 610, copolymerized Nylon, alkoxymethylated Nylon, etc.), polyurethane, gelatin, aluminum oxide, etc. The underlayer has a thickness of 0.1 μm to 5 μm, preferably 0.3 μm to 3 μm.

When the charge transport material in an electron-transporting substance in a photosensitive member comprising an electroconductive support, a charge generation layer and a charge transport layer, laid one upon another in this order, the surface of the charge transport layer must be positively charged, and upon exposure to light after charging, the electrons generated in the charge generation layer are injected into the charge-transport layer at the light-exposed sites to reach the surface, whereby the positive charges are neutralized, causing the attenuation of the surface potential and an electrostatic contrast between the light-exposed sites and the light-unexposed sites. The thus formed electrostatic, latent image can be developed into a visible image with negatively chargeable toners. The visible image can be directly fixed, or after the toner image is transferred onto a paper sheet, a plastic film, etc., the toner image can be developed and fixed. Furthermore, the electrostatic latent image on the photosensitive member can be also transferred onto the insulating layer of a transfer paper and then developed and fixed. Any known developing agents and any known development and fixation procedures can be used in the present invention, and the present invention is not limited to specific ones.

When the charge transport substance is a positive hole transporting substance on the other hand, the surface of the charge transport layer must be negatively charged, and upon exposure to light after charging, the positive holes generated in the charge generation layer are injected into the charge transport layer at the light-exposed sites to reach the surface, whereby the negative charges are neutralized, causing the attenuation of the surface potential and an electrostatic contrast between the light-exposed sites and the light-unexposed sites. Upon development, positively chargeable toners must be used in contrast to the case of the electron-transporting substance.

Another embodiment of the present invention is an electrophotographic, photosensitive member with the aforementioned organic photoconductive azo pigment and the charge-transporting substance in one and same layer, where besides the charge transport substance as above a charge-transferring complex compound consisting of e.g., poly-N-vinylcarbazole and trinitrofluorenone can be used. The electrophotographic, photosensitive member of this embodiment can be prepared by dispersing the organic photoconductive material and the charge-transferring complex compound in a polyester solution of tetrahydrofuran, and forming a film from the dispersion liquid.

Any of the foregoing photosensitive members contains at least one kind of pigment. In order to increase the sensitivity of the photosensitive member or obtain a panchromatic photosensitive member, based on a combination of pigments having different light absorbabilities, two or more of pigments can also be used, if necessary.

The electrophotographic, photosensitive member prepared from the present pigment dispersion liquid can be used not only in electrophotographic copying machines, but also widely in the field of electrophotographic applications such as laser printer, CRT printer, etc.

The present invention will be described in detail below, referring to Examples.

EXAMPLE 1

20 g of a disazo pigment having the following structural formula was added to 400 ml of methylisobutylketone (MIBK) heated to 90° C and heated for 4 hours with stirring.

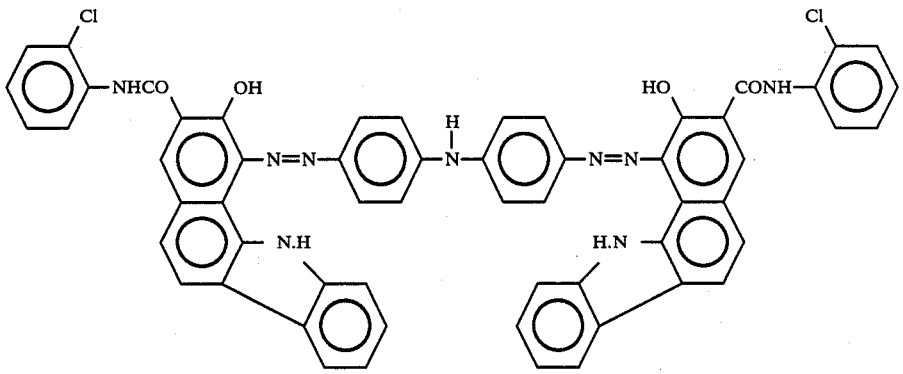

Then, the pigment was separated from the mixture by filtration, washed with 350 ml of MIBK and filtered three times, and dried in a vacuum drier at 80° C. for 6 hours, whereby 19.4 g of solid pigment was obtained.

On the other hand, an aluminum sheet having a thickness of 50 μm was coated with a solution containing 60 g of copolymerized Nylon resin ($\overline{Mn}$=18,000) in 800 ml of a methanol-butanol solvent mixture (2:1 by weight) with a Meyer bar, and heat-dried at 80° C. for 10 minutes, whereby an underlayer having a thickness of 0.5 μm was formed.

Then, 15 g of the previously prepared solid pigment, 12 g of acetate-butyrate-cellulose resin ($\overline{Mn}$=8,500) and 120 g of MIBK were charged into a sand mill with glass beads (1 mm in diameter) and subjected to a dispersion treatment for 5 hours. Then, 100 g of methylethylketone was added to the thus obtained dispersion liquid, and the resulting mixture was applied to the underlayer with a Meyer bar and heat-dried at 100° C. for 10 minutes, whereby a charge generation layer having a thickness of 0.1 μm was obtained.

Then, 60 g of a hydrazone compound having the following formula and 100 g of styrene-methyl methacrylate copolymer (copolymerization ratio of styrene: methyl methacrylate=8:2, $\overline{Mn}$=25,000) were dissolved in 800 ml of chlorobenzene, and the resulting mixture was applied to the charge generation layer with a Meyer bar and heat-dried at 100° C. for 70 minutes, whereby a charge transport layer having a thickness of 16 μm was formed.

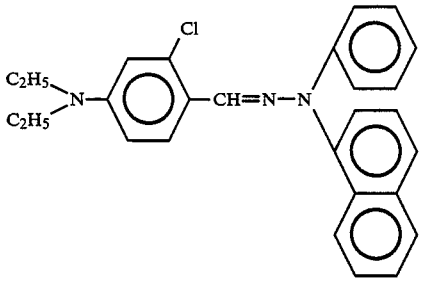

The thus obtained electrophotographic, photosensitive member was made sample 1.

200 g of the same pigment as used in Sample 1 was heated in 400 ml of di-n-propylketone at 90° for 5 hours with stirring, and then the pigment was separated therefrom by filtration, washed with 350 ml of di-n-propylketone and filtered twice and dried in a vacuum drier at 80° C. for 5 hours, whereby 19.5 g of solid pigment was obtained.

Then, 15 g of the solid pigment, 12 g of acetate-butyrate-cellulose resin ($\overline{Mn}$=8,500) and 120 g of THF were charged into a sand mill with glass beads (1 mm in diameter) and subjected to a dispersion treatment for 2 hours, whereby a dispersion liquid was obtained. An electrophotographic, photosensitive member was prepared using dispersion liquid in the same manner as in sample 1. The thus obtained electrophotographic, photosensitive member was made Sample 2.

For comparison, 17.5 g of the same pigment as used for Sample 1 was heated in 350 ml of DMF at 100° C. for 4 hours with stirring, and then the pigment was separated from the solvent by filtration, washed with 300 ml of DMF and filtered twice, and dried in a vacuum drier at 80° C. for 6 hours, whereby 15.9 g of solid pigment was obtained. Then, an electrophotographic, photosensitive member was prepared using this pigment in the same manner as for Sample 1 and was made Comparative Sample 1.

Furthermore, an electrophotographic, photosensitive member was prepared in the same manner as for Sample 1, except that no such heating treatment in the solvent was carried out. This member was made Comparative Sample 2.

The thus prepared electrophotographic, photosensitive members were placed in an electrostatic copying sheet tester (model SP-428, made by Kawaguchi Denki K.K.), corona-charged to −5 KV according to a static system, maintained in a dark place for one second and exposed to light at an illuminance of 5 lux to investigate potential characteristics.

The electrostatic charge characteristics were determined in the surface potential (VD) and the light exposure quantity (E 1/2) necessary to bring the potential upon dark attenuation for one second into ½. The results are shown in Table 1.

TABLE 1

| | $V_D/(-V)$ | El/2 (lux · sec) |
|---|---|---|
| Sample 1 | 640 | 3.4 |
| Sample 2 | 650 | 3.5 |
| Comparative Sample 1 | 605 | 8.9 |
| Comparative Sample 2 | 635 | 7.3 |

Furthermore, the disazo pigment dispersion liquids used for the preparation of Sample 1, Sample 2, Comparative Sample 1 and Comparative Sample 2 were each preserved in a stable state and in a tightly sealed state at room temperature for 60 days and then dispersed particle sizes of pigments were measured by means of a centrifugal precipitation-type particle size distribution analyzer (CAPA-500, made by Horiba Seisakusho K.K.). The results are shown in Table 2.

TABLE 2

| | Average particle size (μm) | |
|---|---|---|
| | Immediately after dispersion | After preservation for 60 days |
| Sample 1 | 0.08 | 0.09 |
| Sample 2 | 0.10 | 0.10 |
| Comparative Sample 1 | 0.32 | 0.94 |
| Comparative Sample 2 | 0.47 | Considerable coagulation and precipitation, (measurement was impossible) |

It is obvious from the results shown in Tables 1 and 2 that the electrophotographic, photosensitive members prepared according to the present process are excellent in the sensitivity and the present dispersion liquids also have a good stability with the lapse of time.

EXAMPLE 2

20 g of a disazo pigment having the following structural formula was heat-treated in MIBK in the same manner as in Example 1, whereby 19.1 g of solid pigment was obtained.

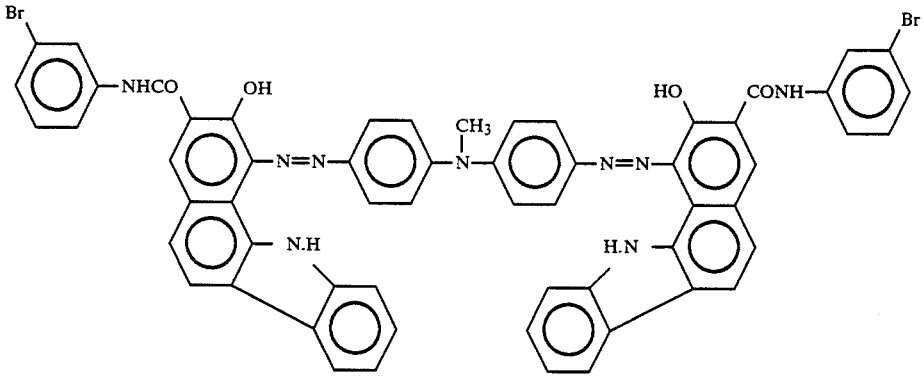

A pigment dispersion liquid was prepared using the thus prepared pigment in the same manner as in Example 1, and an electrophotographic, photosensitive member was prepared therewith and was made Sample 3.

For comparison, an electrophotographic, photosensitive member was prepared in the same manner as for Sample 3 except that no such heat treatment in the solvent was carried out, and the member was made Comparative Sample 3.

The potential characteristics of the thus prepared electrophotographic, photosensitive members were investigated in the same manner as in Example 1 and the results are shown in Table 3.

TABLE 3

| | $V_D(-V)$ | El/2 (lux · sec) |
|---|---|---|
| Sample 3 | 705 | 3.8 |
| Comparative Sample 3 | 680 | 9.5 |

The disazo pigment dispersion liquids used for the preparation of Sample 3 and Comparative Sample 3 were preserved in a tightly sealed state at room temperature and the dispersed particle sizes of pigments were measured in the same manner as in Example 1. The results are shown in Table 4.

TABLE 4

| | Average particle size (μm) | | |
|---|---|---|---|
| | Immediately after dispersion | After preservation for 30 days | After preservation for 60 days |
| Sample 3 | 0.10 | 0.10 | 0.11 |
| Comparative Sample 3 | 0.33 | 0.58 | 1.02 |

It is obvious from the results of Table 3 and 4 that the electrophotographic, photosensitive member prepared according to the present process is excellent in the sensitivity and the dispersion liquid also has a good stability with the lapse of time.

EXAMPLE 3

30 g of a disazo pigment having the following structural formula was put into 600 ml of cyclohexanone heated to 80° C. and heated for 8 hours with stirring.

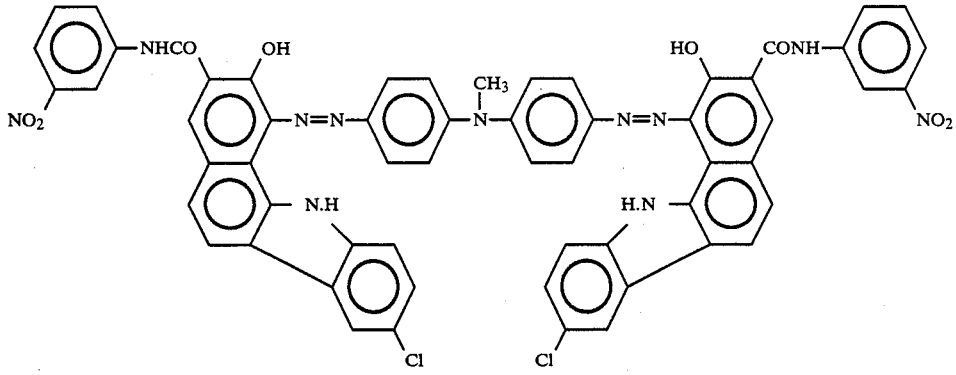

Then, the pigment was separated from the solvent by filtration, washed with 500 ml of cyclohexanone and filtered twice, and dried in a vacuum drier at 70° C. for 8 hours, whereby 29.1 g of the pigment was obtained.

On the other hand, the same Nylon resin solution in the solvent mixture as used in Example 1 was applied to an aluminum cylinder (60 mm in diameter) by dipping and heat-dried at 90° C. for 10 minutes, whereby an underlayer having a thickness of 1.0 μm was formed.

Then, 20 g of the previously obtained pigment, 10 g of polymethyl methacrylate resin ($\overline{Mn}$=15,000) and 300 ml of cyclohexanone were charged into a sand mill with glass beads (1 mm in diameter) and subjected to dispersion for 40 hours. Then, 500 ml of methylethylketone was added to the dispersion, liquid and the resulting mixture was applied to the underlayer by dipping and heat-dried at 90° C. for 10 minutes, whereby a charge generation layer having a thickness of 0.15 μm was formed.

Then, the same solution containing the hydrazone compound and the styrene-methyl methacrylate copolymer in chlorobenzene as used in Example 1 was applied to the charge generation layer by dipping and heat-dried at 120° C. for 80 minutes, whereby a charge transport layer having a thickness of 20 μm was formed. The thus prepared electrophotographic, photosensitive member was made Sample 4.

For comparison, an electrophotographic, photosensitive member was prepared in the same manner as for Sample 4, except that no such heating treatment in cyclohexanone was carried out. The member thus prepared was made Comparative Sample 4.

The thus prepared electrophotographic, photosensitive members were mounted on a laser beam printer (LBP-CX, made by Canon) and a charger of the printer and the laser beam quantity were so adjusted as to obtain a contrast between the dark potential ($V_D$) of −750 V and the light potential ($V_L$) of −250 V. The laser beam quantity of Sample 4 and Comparative Sample 4 were measured at a sensitivity of E500V (unit: μJ/cm²). The results are shown in Table 5.

TABLE 5

| | Sensitivity E500V (μJ/cm²) |
|---|---|
| Sample 4 | 2.7 |
| Comparative Sample 4 | 5.3 |

Changes in the pigment particle sizes of the disazo pigment dispersion liquids, prepared with Sample 4 and Comparative Sample 4, respectively, were measured in a tightly sealed state during dispersion and with the lapse of 60 days-preservation after dispersion in the same particle size distribution analyzer as used in Example 1. The results are shown in FIG. 1.

It is obvious from the results of Table 5 and FIG. 1 that the electrophotographic, photosensitive member prepared according to the present process in excellent in the sensitivity and the dispersion liquid also has a good stability during dispersion and with the lapse of preservation.

What we claim is:

1. In a process for preparing an electrophotographic, photosensitive member, which comprises (a) a step of forming a charge generation layer by applying and drying a dispersion liquid containing an organic photoconductive azo pigment represented by the following general formula:

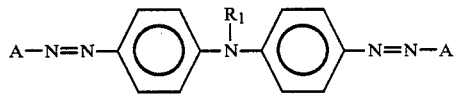

wherein $R_1$ represents a hydrogen atom of a substituted or unsubstituted alkyl group and A represents a coupler residue having a phenolic hydroxyl group, and (b) a step of forming a charge transport layer by applying and drying a solution of a charge-transporting substance, said charge transport layer being formed on an electroconductive support either before or after formation of said charge generation layer, the improvement which comprises subjecting said organic photoconductive azo pigment to a heating pretreatment step in a ketone-type solvent prior to forming said dispersion liquid.

2. A process according to claim 1, wherein the A of the general formula is represented by the following general formula:

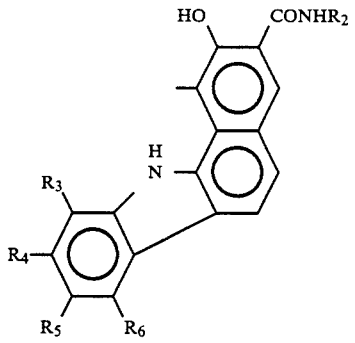

wherein $R_2$ represents a substituted or unsubstituted alkyl group, aryl group, aralkyl group or heterocyclic group and $R_3$, $R_4$, $R_5$ $R_6$ represent a hydrogen atom, a halogen atom, a hydroxyl group, a nitro group, a trifluoromethyl group, a cyano group, an alkyl group, an alkoxy group or a substituted or unsubstituted aryl group, aralkyl group or amino group.

3. A process according to claim 1, wherein the solvent for dispersion of the azo pigment is a ketone type solvent.

4. A process according to claim 1, wherein the ketone type solvent for the heating treatment is methylisobutylketone, di-n-propylketone, cyclopentanone or cyclohexanone.

5. A process according to claim 1, wherein the heating treatment is carried out at a temperature of 50° C. or higher.

6. A process according to claim 1, wherein the charge transporting substance is selected from a hydrazone type compound, a styryl type compound, a pyrazoline type compound, an oxazole type compound, a thiazole type compound, a triarylmethane type compound and a polyarylalkane.

7. In an electrophotographic photosensitive member, which comprises an electroconductive support, a charge generation layer formed by applying and drying a dispersion liquid containing an organic photoconductive azo pigment represented by the following general formula:

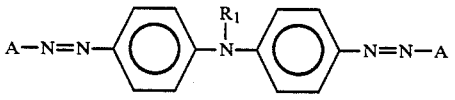

wherein $R_1$ represents a hydrogen atom of a substituted or unsubstituted alkyl group and A represents a coupler residue having a phenolic hydroxyl group and a charge transport layer formed by applying and drying a solution of a charge-transporting substance, said charge transport layer being formed on said electroconductive support either before or after formation of said charge generating layer the improvement which comprises employing said organic photoconductive azo pigment which has been subjected to a heating pretreatment step in a ketone-type solvent prior to forming said dispersion liquid.

8. An electrophotographic photosensitive member according to claim 7, wherein the a of the general formula is represented by the following general formula:

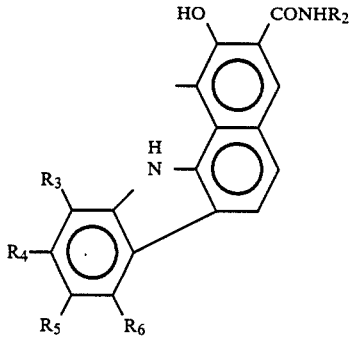

wherein $R_2$ represents a substituted or unsubstituted alkyl group, aryl group, aralkyl group or heterocyclic group and $R_3$, $R_4$, $R_5$ and $R_6$ represent a hydrogen atom, a halogen atom, a hydroxyl group, a nitro group, a trifluoromethyl group, a cyano group, an alkyl group, an alkoxy group, or a substituted or unsubstituted aryl group, aralkyl group or amino group.

9. An electrophotographic photosensitive member according to claim 7, wherein the charge transporting substance is selected from a hydrazone type compound, a styryl type compound, a pyrazoline type compound, an oxazole type compound, a thiazole type compound, a triarylmethane type compound and a polyarylalkane.

10. A process according to claim 1, which comprises a step of forming an underlayer.

11. A process according to claim 1, wherein a charge transport layer is formed on a charge generation layer.

12. In a process for preparing an electrophotographic, photosensitive member, which comprises a step of forming a photosensitive layer by applying and drying a dispersion liquid containing a charge-transporting substance and an organic photoconductive azo pigment represented by the following general formula:

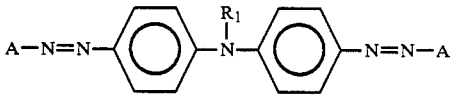

wherein $R_1$ represents a hydrogen atom of a substituted of unsubstituted alkyl group and A represents a coupler residue having a phenolic hydroxyl group, the improvement comprising subjecting said organic photoconductive azo pigment to a heating treatment in a ketone-type solvent prior to forming said dispersion liquid.

* * * * *

UNITED STATES PATENT AND TRADEMARK OFFICE

CERTIFICATE OF CORRECTION

PATENT NO. : 4,895,782

DATED : January 23, 1990

INVENTOR(S) : TAKASHI KOYAMA, ET AL.

It is certified that error appears in the above-identified patent and that said Letters Patent is hereby corrected as shown below:

IN THE DRAWING

FIG. 1, "60 (dc (PRESERVATION TIMI" should read

--60 (day) (PRESERVATION TIME) --.

COLUMN 1

Line 15, "in" should read --an--.
Line 20, "sulfide" should read --sulfide,--.
Line 62, "Lall" should read --ball--.

COLUMN 4

Line 27, "cyano" should read --cyano,--.

COLUMN 18

Line 54, "of" should read --or--.

COLUMN 19

Line 18, "$R_3$, $R_4$, $R_5$ $R_6$" should read --$R_3$, $R_4$, $R_5$ and $R_6$--.
Line 52, "of" should read --or--.

UNITED STATES PATENT AND TRADEMARK OFFICE

CERTIFICATE OF CORRECTION

PATENT NO. : 4,895,782

DATED : January 23, 1990

INVENTOR(S) : TAKASHI KOYAMA, ET AL.

It is certified that error appears in the above-identified patent and that said Letters Patent is hereby corrected as shown below:

COLUMN 20

Line 5, "a" should read --A--.
Line 53, "of" should read --or--.
Line 54, "of" should read --or--.

Signed and Sealed this

Fourteenth Day of August, 1990

*Attest:*

HARRY F. MANBECK, JR.

*Attesting Officer*

*Commissioner of Patents and Trademarks*